US008236075B2

(12) United States Patent
Yan et al.

(10) Patent No.: US 8,236,075 B2
(45) Date of Patent: Aug. 7, 2012

(54) BAMBOO CHARCOAL COMPOSITE ABRASIVE MATERIAL AND METHOD OF FABRICATING THE SAME

(75) Inventors: Biing-Hwa Yan, Kaohsiung (TW); Shin-Min Lee, Taoyuan County (TW); Jung-Chou Hung, Kaohsiung County (TW)

(73) Assignee: National Central University, Jhongli (TW)

( * ) Notice: Subject to any disclaimer, the term of this patent is extended or adjusted under 35 U.S.C. 154(b) by 593 days.

(21) Appl. No.: 12/505,470

(22) Filed: Jul. 18, 2009

(65) Prior Publication Data

US 2010/0307066 A1 Dec. 9, 2010

(30) Foreign Application Priority Data

Jun. 4, 2009 (TW) ..... 98118529 A

(51) Int. Cl.

| | |
|---|---|
| ***B05D 7/22*** | (2006.01) |
| ***B24D 3/06*** | (2006.01) |
| ***B32B 9/00*** | (2006.01) |
| ***C09D 7/00*** | (2006.01) |
| ***C09K 3/14*** | (2006.01) |

(52) U.S. Cl. ..... 51/309; 51/298; 51/307; 51/293; 106/287.35; 427/180; 427/181; 427/230; 427/243; 427/322; 427/439; 427/443.1

(58) Field of Classification Search ..... 51/293, 51/307, 295, 298, 309; 205/109, 110; 427/230, 427/235, 238, 243, 560, 385.5, 392, 439, 427/443.11; 106/287.35; 428/408
See application file for complete search history.

(56) References Cited

OTHER PUBLICATIONS

Zhang et al., Magnetic Finishing Abrasive with Nickel-Plated Active Carbon, 2005, Journal of the Electrochemical Society, 152, 9, pp. D121-D123.*

* cited by examiner

*Primary Examiner* — Roy King
*Assistant Examiner* — Jared Wood
(74) *Attorney, Agent, or Firm* — Jackson IPG PLLC

(57) ABSTRACT

An abrasive material is fabricated. The material is made of bamboo charcoal. The charcoal has vascular bundles and abrasive particles are uniformly distributed and fixed on inner surfaces of the vascular bundles. Thus, the abrasive material can be used with self-sharpening for grinding, polishing, lubricating, etc.

9 Claims, 6 Drawing Sheets

BAMBOO CHARCOAL COMPOSITE ABRASIVE MATERIAL AND METHOD OF FABRICATING THE SAME

BACKGROUND

1. Field of the Invention

The present invention relates to an abrasive material; more particularly, relates to fabricating an abrasive material having abrasive particles uniformly distributed within for grinding and lubricating with self-sharpening, where the abrasive material is obtained through easy fabricating process with low cost and high quality.

2. Description of the Related Art

Needs are increased in technologies for precise molds and super-precise surface, like mold polishing and wafer polishing. Concerning surface polishing, free abrasives polishing, electro polishing and chemical mechanical polishing are used most often.

A prior art of abrasive pad has micropores each smaller than 50 μm, where more than 75% of the micropores are smaller than 20 μm. The abrasive pad is made with a single-phase solution which is obtained with a polymer resin and a supercritical gas combined together. Another prior art of abrasive pad processes lens, mirror, silicon wafer, glass-ceramic based rigid disk, alumina substrate and metal to obtain flat surface with stable and high efficiency. Another prior art of abrasive pad uses a technology similar to LIGA to form a photoresist master mold on a metal substrate; and then particles of metal and ceramics are simultaneously deposited in the photoresist master mold. The particles of metal can be particles of nickel (Ni), alloy of Ni, copper (Cu), alloy of Cu, diamond, cubic boron nitride (CBN), aluminum oxide (Al2O3), zinc oxide (ZnO2), silicon carbide (SiC), etc. The abrasive pad can be a tool for making mini diamond grinding rod or spindle.

In the other hand, bamboo charcoal is a material made of bamboo. It has various applications, like soil improvement agent, odor absorber, water purifier, etc. Yet, products related to bamboo charcoal are still developed in an early stage.

However, most polish technologies use polishing cloths, which are not fit for curve of irregular surface; and, bamboo charcoal used in abrasive material is not found. Hence, the prior arts do not fulfill all users' requests on actual use.

SUMMARY OF THE INVENTION

The main purpose of the present invention is to provide an abrasive material having abrasive particles uniformly distributed for grinding and lubricating with self-sharpening, where the abrasive material is obtained through easy fabricating process with low cost and high quality.

To achieve the above purpose, the present invention is a bamboo charcoal composite abrasive material and a method of fabricating the same, where the bamboo charcoal composite abrasive material comprises a carrier, a coating layer and a plurality of abrasive particles; the carrier has a plurality of vascular bundles as pores; the coating layer is coated with a metal coating on inner surface of the vascular bundle in the bamboo charcoal carrier; the abrasive particles are uniformly distributed in the metal coating; and the bamboo charcoal composite abrasive material has a method of fabricating the same, comprising steps of: (a) obtaining a carrier having a plurality of vascular bundles as pores; (b) processing the carrier into a certain length and grinding a sectional end surface of the carrier to obtain a flow entry plane; (c) sinking the carrier into a solution and releasing air in the vascular bundles of the carrier through ultrasonic vibration; (d) obtaining a tank, the tank containing a solution of a metal coating with abrasive particles uniformly distributed in the solution; (e) transferring the abrasive particles into the vascular bundles of the carrier by fluid pressure; and (f) obtaining a coating layer of the metal coating on an inner surface of each of the vascular bundles of the carrier to fix the abrasive particles on the vascular bundles. Accordingly, a novel bamboo charcoal composite abrasive material and a method of fabricating the same are obtained.

BRIEF DESCRIPTION OF THE DRAWINGS

The present invention will be better understood from the following detailed description of the preferred embodiment according to the present invention, taken in conjunction with the accompanying drawings, in which.

DESCRIPTION OF THE PREFERRED EMBODIMENT

Figure 1:
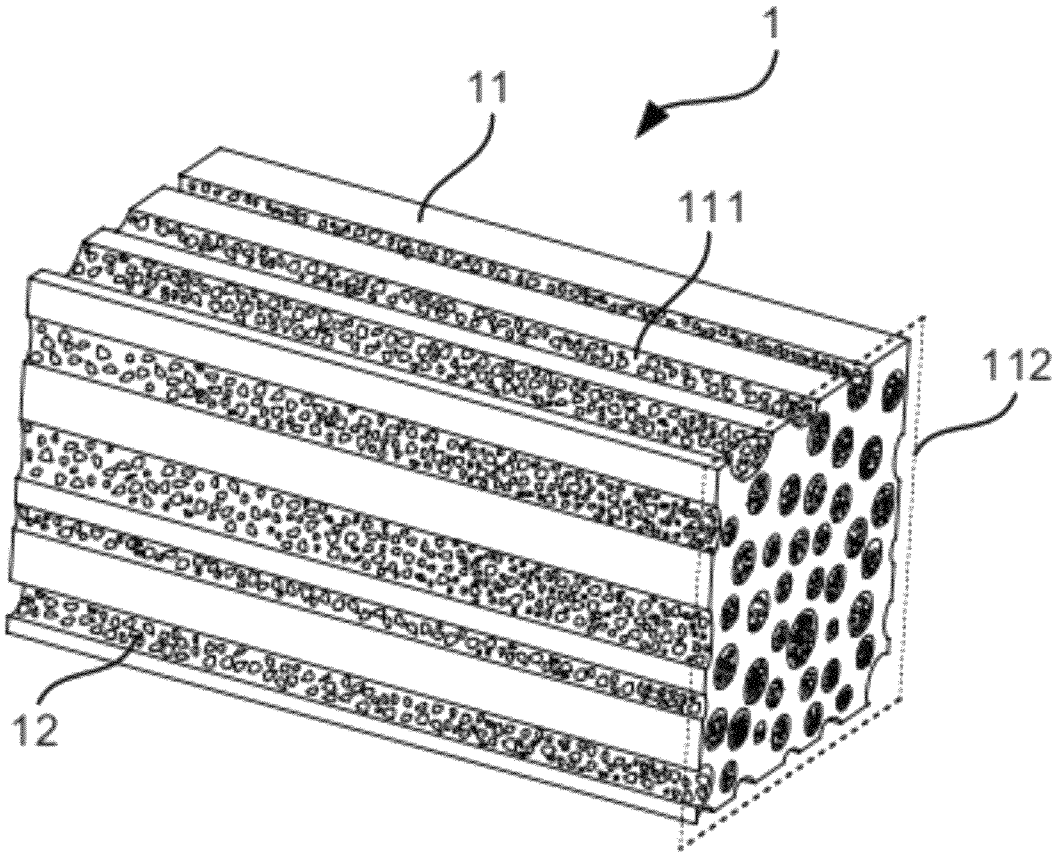
FIG. 1 is the structural view showing the preferred embodiment of the abrasive material according to the present invention.
Figure 2:
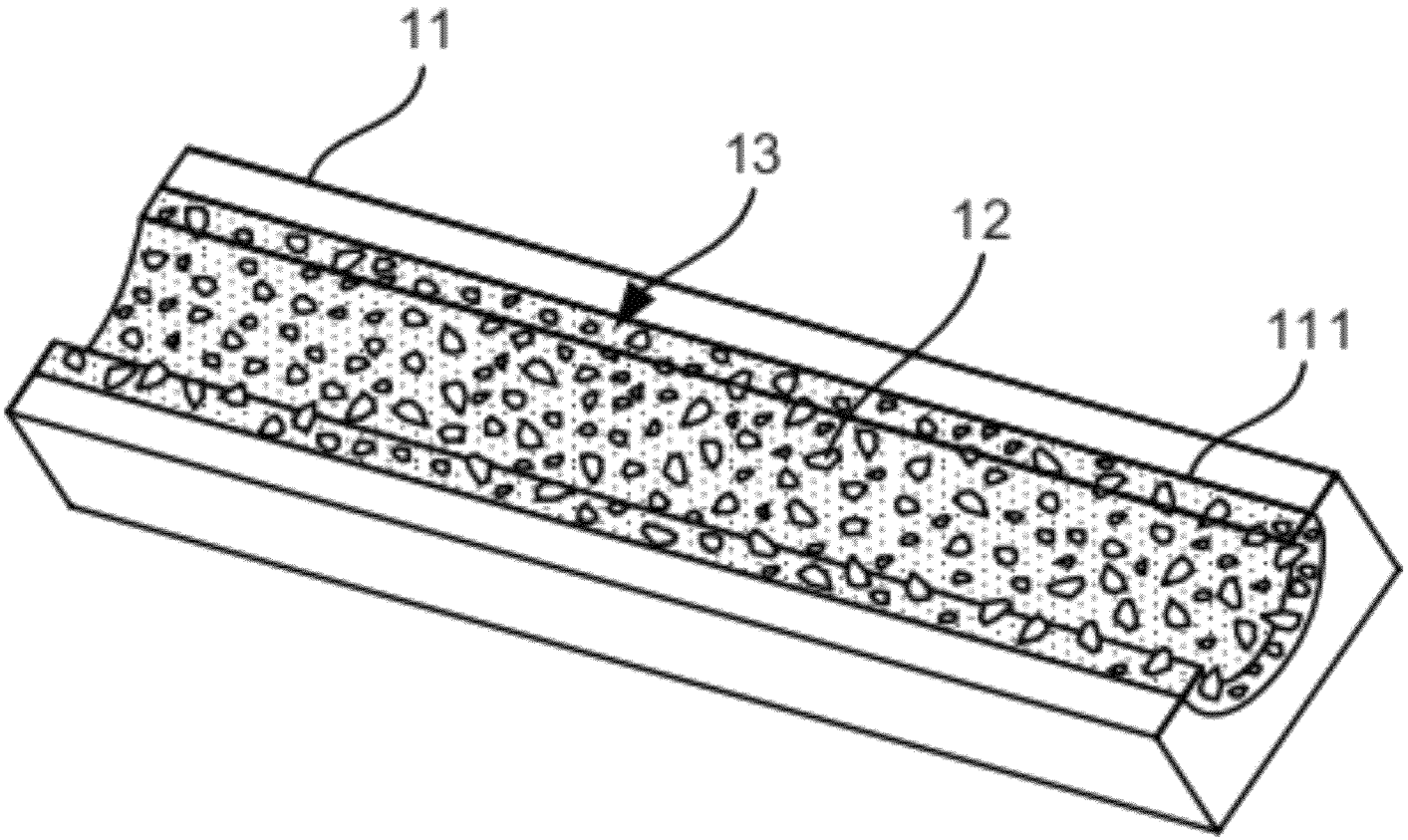
FIG. 2 is the first sectional view showing the abrasive material.
Figure 3:
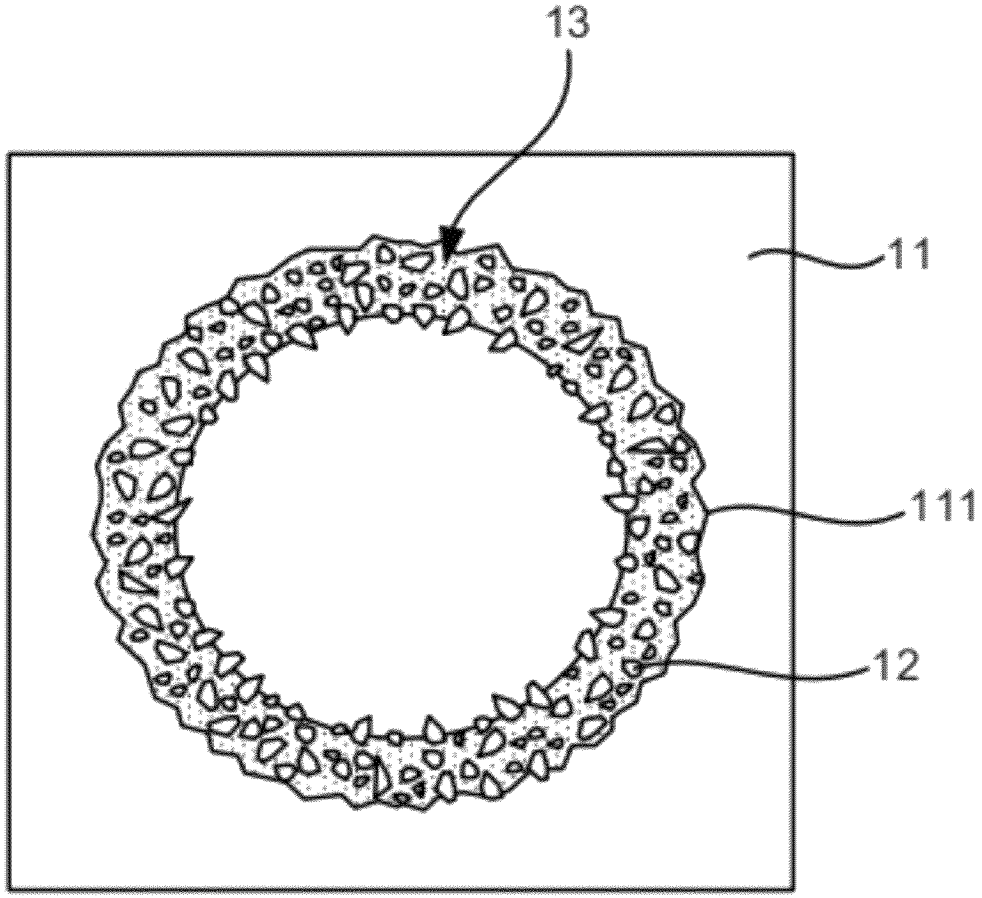
FIG. 3 is the second sectional view showing the abrasive material.

The following description of the preferred embodiment is provided to understand the features and the structures of the present invention.

Please refer to FIG. 1 to FIG. 4, which are a structural view showing the preferred embodiment of the abrasive material according to the present invention; a first sectional view and a second sectional view showing an abrasive material; and a flow view showing a method of fabricating the abrasive material. As shown in the figures, the present invention is a bamboo charcoal composite abrasive material and a method of fabricating the same. The bamboo charcoal composite abrasive material 1 touches a surface of an object to grind or lubricate the object with a surface having abrasive particles, where the bamboo charcoal composite abrasive material 1 comprises a carrier 11, a coating layer 12 and a plurality of abrasive particles 13.

The carrier 11 is made of bamboo charcoal or coconut charcoal, which has a plurality of vascular bundles 111. The coating layer 12 is coated with a metal coating on an inner surface of each vascular bundle, where the metal coating is made of metal or an alloy of metal; and the metal is nickel (Ni), chromium (Cr), copper (Cu), aluminum (Al) or zinc (Zn). The abrasive particles 13 are uniformly distributed in the metal coating. Since the vascular bundles 111 are well arranged in the carrier 11, the sectional surface of bamboo charcoal composite abrasive material 1 has well-arranged abrasive particles 13. Therein, each abrasive particle 13 has a size ranged from 0.1 micro-meter (μm) to 10 μm; and is made of diamond, silicon carbide (SiC), cubic boron nitride (CBN) and aluminum oxide (Al2O3).

Figure 4:
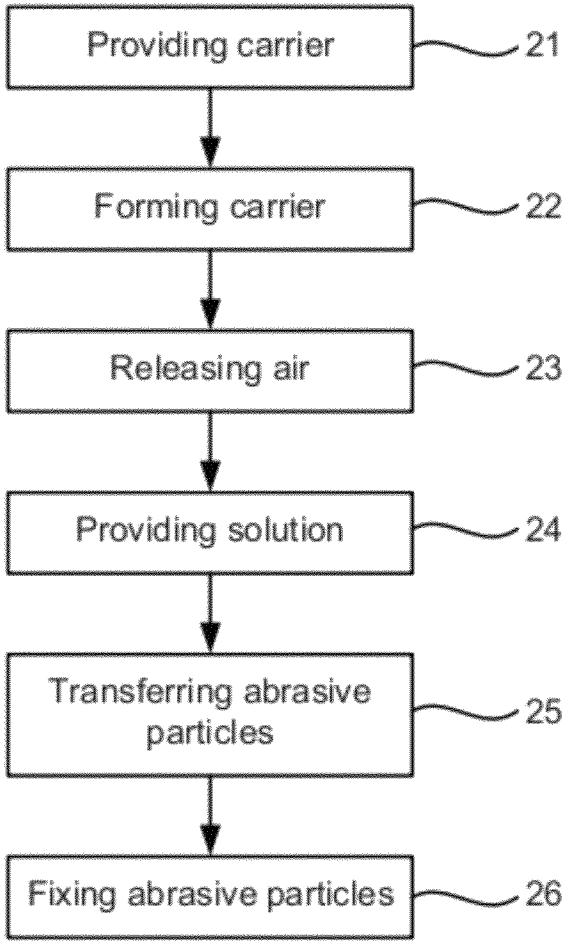
FIG. 4 is the flow view showing the method of fabricating the abrasive material.

In FIG. 4, the bamboo charcoal composite abrasive material 1 has a method of fabricating the same, comprising the following steps:

(a) Providing carrier 21: A bamboo charcoal carrier 11 having vascular bundles 111 is provided.

(b) Forming carrier 22: The carrier 11 is processed into a certain length and a sectional end surface of the carrier 11 is grinded to obtain a flow entry plane.

(c) Releasing air 23: The carrier 11 is sunk into a solution; and air in the vascular bundles of the carrier 11 is released through ultrasonic vibration for infiltration to greatly reduce clogging in the vascular bundles.

(d) Providing solution 24: A tank is provided, where the tank contains a solution of a metal coating which is uniformly distributed with abrasive particles 13.

(e) Transferring abrasive particles 25: The abrasive particles 13 are transferred into the vascular bundles of the carrier 11 by fluid pressure.

(f) Fixing abrasive particles 26: A coating layer of the metal coating is deposited on inner surface of each vascular bundle of the carrier 11 to fix the abrasive particles on the vascular bundles. Thus, a bamboo charcoal composite abrasive material 1 is fabricated.

Therein, a cleansing process to the vascular bundles is further comprised in each step of step (c) to step (f).

The bamboo charcoal carrier 11 having vascular bundles 111 may obtain its shape and size through turning, milling, clamping, shaving, sawing, grinding, etc. The bamboo charcoal carrier 11 is shaped through cutting and grinding according to the present invention. Therein, the bamboo charcoal carrier 11 is roughly processed to a certain size at first; and then is finished to obtain a flow entry plane 112 of a sectional end surface.

Figure 5:
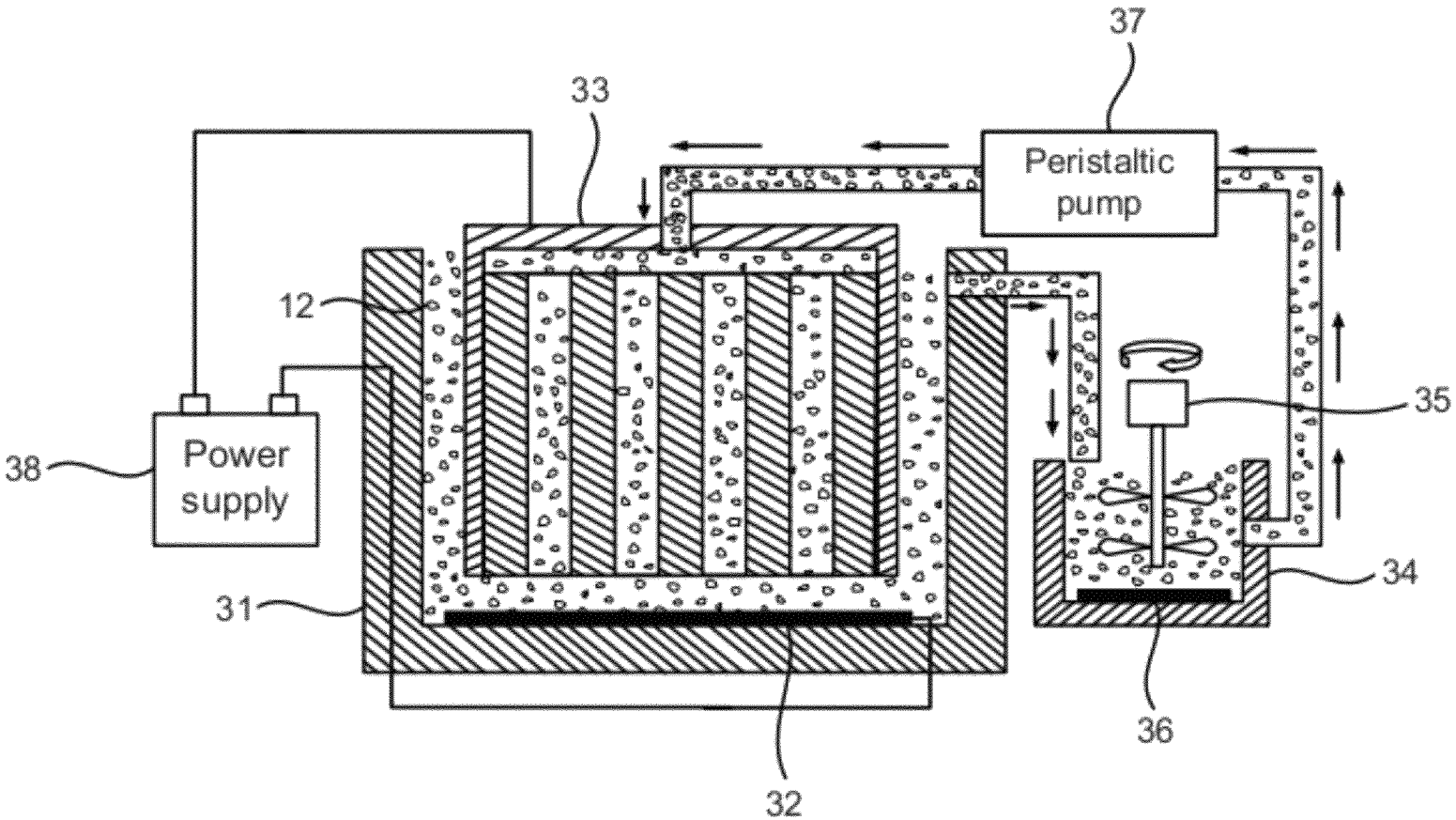
FIG. 5 is the view showing a state of electroplating.

Please further refer to FIG. 5, which is a view showing a state of electroplating. As shown in the figure, a composite coating system is used for a conductive bamboo charcoal carrier 11 to obtain a bamboo charcoal composite abrasive material 1. The composite coating system has a coating tank 31, where the coating tank 31 has an anode 32 and a cathode 33. Outside of the coating tank 31, there are a stir tank 34, a peristaltic pump 37 and a power supply 38. The stir tank 34 contains a stir motor 35 and a heater 36. Therein, the coating tank 31 contains a solution having abrasive particles 13. On using the coating tank 31, a plastic tube is covered at outside of the carrier 11 to pass the solution for coating with the abrasive particles 13 having a size of 2~4 μm. The abrasive particles 13 are suspended in the solution by using the stir tank 34 and the stir motor 35. The solution is added with a surfactant to enhance depositing and dispersing the abrasive particles 13. After the abrasive particles 13 are deposited and fixed on inner surfaces of the vascular bundles 111 of the bamboo charcoal carrier 11, the bamboo charcoal carrier 11 is washed to clean out the solution left on surface. Thus, the bamboo charcoal composite abrasive material 1 is obtained.

Or, for a conductive or non-conductive bamboo charcoal carrier 11, an electroless deposition system (not shown in the figures) is used to obtain a bamboo charcoal composite abrasive material 1. On using the system, a plastic tube is covered at outside of the carrier 11 to pass a solution for coating with the abrasive particles 13 through electroless plating, where the abrasive particle has a size of 2~4 μm. After the abrasive particles 13 are deposited and fixed on inner surfaces of the vascular bundles 111 of the carrier 11, the carrier 11 is washed to clean out the solution left on surface. Thus, the bamboo charcoal composite abrasive material 1 is obtained.

Or, for a conductive or non-conductive bamboo charcoal carrier 11, a resin-mixed abrasive packing system (not shown in the figures) may be used to obtain a bamboo charcoal composite abrasive material 1. On using the system, a plastic tube is covered at outside of the carrier 11 to pass a solution of resin-mixed abrasive for coating with the abrasive particles 13 having a size of 2~4 μm. After the abrasive particles 13 are deposited and fixed on inner surfaces of the vascular bundles 111 of the carrier 11 through heating up, the carrier 11 is washed to clean out the solution left on surface. Thus, the bamboo charcoal composite abrasive material 1 is obtained.

With the vascular bundles of the bamboo charcoal carrier 11, the abrasive particles 13 are transferred to form a coating layer through depositing, where the abrasive particles 13 are uniformly distributed for grinding and lubricating with self-sharpening. Thus, a bamboo charcoal composite abrasive material is obtained through easy fabricating process with low cost and high quality.

On using, the bamboo charcoal composite abrasive material 1 is pressed on a surface of an object to process with the abrasive particles. At the moment, powders may be fallen off for polishing with self-lubricating. Then, new abrasive particles are revealed for self-sharpening. Thus, the novel material according to the present invention is used for polishing and deburring.

Figure 6:
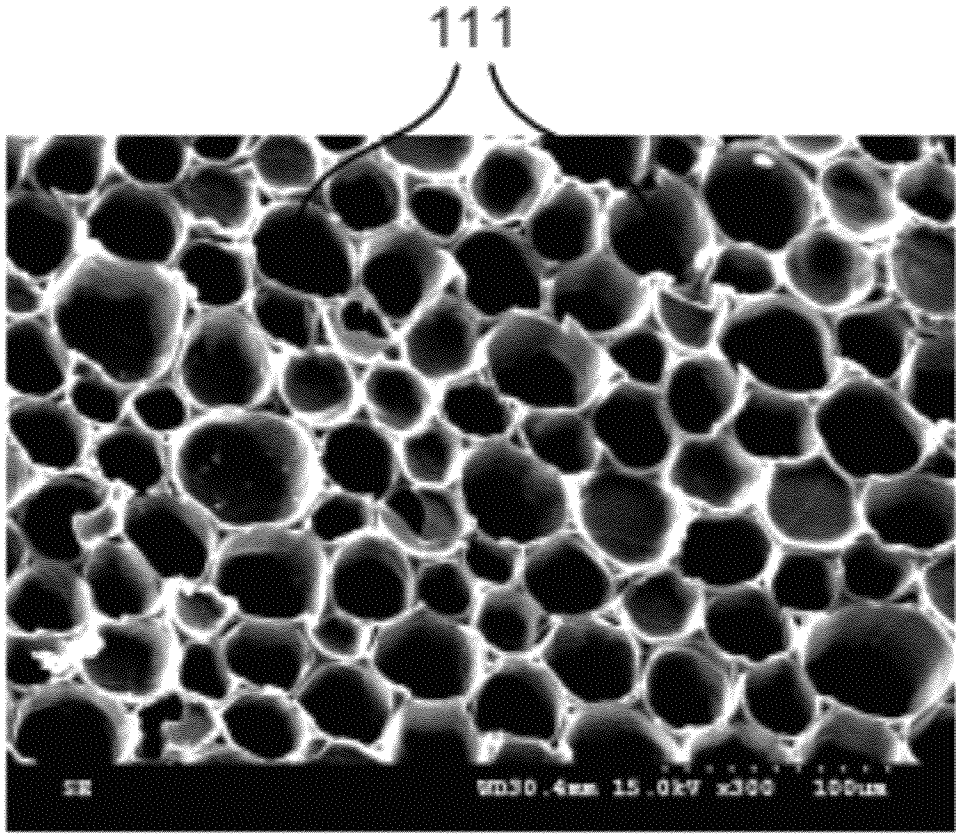
FIG. 6 is the sectional view showing the bamboo charcoal carrier by the electron microscope.

Please refer to FIG. 6, which is a sectional view showing a bamboo charcoal carrier by the electron microscope. As shown in the figure, vascular bundles of the bamboo charcoal are arranged with various sizes. Resistance coefficient and pore characteristics of a bamboo charcoal carrier are related to carbonization temperature, where the resistance coefficient is raised as the carbonization temperature is raised to turn insulator into semiconductor and finally into conductor. When the carbonization temperature is between 700° C. and 900° C., the resistance coefficient is between 0.12 and 11.9 Ω·cm, which is fit for cathode. The pore characteristics of the bamboo charcoal may be macropore, mesopore or micropore. Hence, the abrasive particles can be transferred into the vascular bundles of the bamboo charcoal by fluid pressure. Besides, the carrier can be either made of bamboo charcoal or coconut charcoal, where coconut charcoal is obtained from waste of coconut shell and the coconut charcoal thus made is environmental protected.

To sum up, the present invention is a bamboo charcoal composite abrasive material and a method of fabricating the same, where a composite abrasive material has abrasive particles uniformly distributed for grinding and lubricating with self-sharpening; and the bamboo charcoal composite abrasive material is obtained through easy fabricating process with low cost and high quality.

The preferred embodiment herein disclosed is not intended to unnecessarily limit the scope of the invention. Therefore, simple modifications or variations belonging to the equivalent of the scope of the claims and the instructions disclosed herein for a patent are all within the scope of the present invention.

What is claimed is:

1. A bamboo charcoal composite abrasive material, comprising a bamboo charcoal carrier, said carrier having a plurality of vascular bundles as pores;

a coating layer, comprising a metal coating on an inner surface of said vascular bundles in said bamboo charcoal carrier; and a plurality of abrasive particles, said abrasive particles being uniformly distributed in said metal coating.

2. The material according to claim 1, wherein said metal coating is made of a material selected from a group consisting of a metal and an alloy of said metal; and wherein said metal is selected from a group consisting of nickel (Ni), chromium (Cr), copper (Cu), aluminum (Al) and zinc (Zn).

3. The material according to claim 1, wherein said abrasive particles are made of a material selected from a group consisting of diamond, silicon carbide (SiC), cubic boron nitride (CBN) and aluminum oxide ($Al_2O_3$).

4. The material according to claim 1, wherein said abrasive particles have a size between 0.1 micro-meter (μm) and 10 μm.

5. A method of forming a bamboo charcoal composite abravise material, comprising steps of:

(a) providing a bamboo charcoal carrier having a plurality of vascular bundles as pores;

(b) processing said carrier into a certain length and grinding a sectional end surface of said carrier to obtain a flow entry plane;

(c) sinking said carrier into a solution and releasing air in said vascular bundles of said carrier through ultrasonic vibration;

(d) providing a tank, said tank containing a solution of a coating material with abrasive particles uniformly distributed;

(e) transferring said abrasive particles into said vascular bundles of said carrier by fluid pressure; and (f) forming a coating layer on an inner surface of each of said vascular bundles of said carrier to fix said abrasive particles on said vascular bundles.

6. The method according to claim 5, wherein each step of step (c) to step (f) further comprises a step of cleansing said vascular bundles.

7. The method according to claim 6, wherein said cleansing process is ultrasonic cleansing.

8. The method according to claim 5, wherein said coating layer is formed of of a conductive material by using a composite coating system.

9. The method according to claim 5, wherein said coating layer is made of a material and is obtained on said inner surface of each of said vascular bundles of said carrier by using a system, said material being selected from a group consisting of a conductive material and a non-conductive material; and wherein said system is selected from a group consisting of an electroless plating system and a resin-mixed abrasive packing system.

* * * * *